US008628458B2

(12) United States Patent
Träger

(10) Patent No.: US 8,628,458 B2
(45) Date of Patent: Jan. 14, 2014

(54) THREE-PHASE SEPARATOR HAVING AN OVERFLOW OUTLET FOR ONE PHASE AND A CENTRIPETAL PUMP FOR ANOTHER PHASE

(75) Inventor: Kim Träger, Kalundborg (DK)

(73) Assignee: GEA Mechanical Equipment GmbH, Oelde (DE)

( * ) Notice: Subject to any disclaimer, the term of this patent is extended or adjusted under 35 U.S.C. 154(b) by 934 days.

(21) Appl. No.: 12/667,246

(22) PCT Filed: Jun. 27, 2008

(86) PCT No.: PCT/EP2008/005240

§ 371 (c)(1),
(2), (4) Date: Dec. 30, 2009

(87) PCT Pub. No.: WO2009/003639

PCT Pub. Date: Jan. 8, 2009

(65) Prior Publication Data

US 2010/0184579 A1 Jul. 22, 2010

(30) Foreign Application Priority Data

Jun. 30, 2007 (DE) ..... 20 2007 009 212

(51) Int. Cl.
*B04B 11/02* (2006.01)

(52) U.S. Cl.
USPC ..... 494/25; 494/56; 494/70

(58) Field of Classification Search
USPC ..... 494/1–3, 10, 23, 25–30, 56–57, 68–73
See application file for complete search history.

(56) References Cited

U.S. PATENT DOCUMENTS 3,408,000 A * 10/1968 Nilson ..... 494/10
3,445,061 A * 5/1969 Nilson ..... 494/3
3,563,453 A * 2/1971 Kompert et al. ..... 494/3
3,580,493 A * 5/1971 Jonsson ..... 494/2
3,601,307 A * 8/1971 Shapiro ..... 494/15

(Continued)

FOREIGN PATENT DOCUMENTS

DE 11 40 144 11/1962
DE 3806742 A1 * 10/1988

(Continued)

OTHER PUBLICATIONS

International Search Report for International Application No. PCT/EP2008/0052405, mailed Oct. 22, 2008.

*Primary Examiner* — Charles E Cooley
(74) *Attorney, Agent, or Firm* — Barnes & Thornburg LLP

(57) ABSTRACT

A separator including a separator drum having a conical interior and rotatably mounted at an axial end about a vertical axis of rotation. A rotating spindle is located at either a lower or upper end of the separator drum and is configured to drive the separator drum. The rotating spindle is disposed in an oscillating manner about a hinge point. Also included is supply tube for a product to be processed and two fluid outlets. One fluid outlet is for a light phase and one fluid outlet is for a heavy phase. A solids material discharge opening is located in an area of the separator drum's largest inner circumference. Further included is a separation pan assembly. A pressure chamber is configured to be acted upon by a fluid to change a location of a separation zone between the light phase and the heavy phase.

6 Claims, 3 Drawing Sheets

(56) References Cited

U.S. PATENT DOCUMENTS

| | | | | | |
|---|---|---|---|---|---|
| 3,637,134 | A | * | 1/1972 | Nelson | 494/2 |
| 3,642,196 | A | * | 2/1972 | Nilsson | 494/2 |
| 3,750,940 | A | * | 8/1973 | Nilsson | 494/3 |
| 3,752,389 | A | * | 8/1973 | Nilsson | 494/3 |
| 3,976,242 | A | * | 8/1976 | Hemfort | 494/3 |
| 3,990,632 | A | * | 11/1976 | Hemfort | 494/2 |
| 4,193,537 | A | * | 3/1980 | Bodelson et al. | 494/48 |
| 4,305,817 | A | * | 12/1981 | Kohlstette | 210/104 |
| 4,343,431 | A | * | 8/1982 | Wehling | 494/30 |
| 4,417,885 | A | * | 11/1983 | Kohlstette et al. | 494/23 |
| 4,525,155 | A | * | 6/1985 | Nilsson | 494/3 |
| 4,755,165 | A | * | 7/1988 | Gunnewig | 494/37 |
| 4,820,256 | A | * | 4/1989 | Nordstrom | 494/3 |
| 5,104,371 | A | * | 4/1992 | Ajnefors | 494/27 |
| 5,788,622 | A | * | 8/1998 | Borgstrom et al. | 494/57 |
| 6,837,842 | B1 | * | 1/2005 | Dellden | 494/2 |
| 6,976,948 | B1 | * | 12/2005 | Hamblad | 494/37 |
| 7,485,084 | B2 | * | 2/2009 | Borgstrom et al. | 494/2 |
| 7,678,039 | B2 | * | 3/2010 | Åstrom | 494/37 |
| 8,192,342 | B2 | * | 6/2012 | Trager et al. | 494/1 |
| 2008/0171645 | A1 | * | 7/2008 | Borgstrom et al. | 494/2 |
| 2009/0298666 | A1 | * | 12/2009 | Trager et al. | 494/10 |
| 2010/0184579 | A1 | * | 7/2010 | Trager | 494/56 |
| 2013/0029828 | A1 | * | 1/2013 | Haggmark et al. | 494/2 |

FOREIGN PATENT DOCUMENTS

| | | | | |
|---|---|---|---|---|
| DE | 10 2005 02133 | | 11/2006 | |
| WO | 86/01436 | | 3/1986 | |
| WO | 92/07658 | | 5/1992 | |
| WO | 2006/096113 | | 9/2006 | |
| WO | WO 2006096113 | A1 * | 9/2006 | B04B 1/08 |

* cited by examiner

THREE-PHASE SEPARATOR HAVING AN OVERFLOW OUTLET FOR ONE PHASE AND A CENTRIPETAL PUMP FOR ANOTHER PHASE

CROSS-REFERENCE TO RELATED APPLICATIONS

This application is a National Phase Application based upon and claiming the benefit of priority to PCT/EP2008/005240, filed on Jun. 27, 2008, which is based upon and claims the benefit of priority to German Patent Application No. 20 2007 009212.1, filed on Jun. 30, 2007, the contents of both of which are incorporated herein by reference.

BACKGROUND AND SUMMARY

The present disclosure relates to a separator including a single or double conical drum rotatably mounted on one of its axial ends about a vertical axis of rotation.

Separators of this type have been known for a long time. As a rule, fluid outlets are provided with so-called centripetal pumps in which the effect is that the rotational energy of the entering fluid is converted to a back pressure in the outlet pipe. Such centripetal pumps have been successful. In particular, it is possible to vary the existing back pressure by throttling, thereby varying the separation zone in the drum or the radius of the separating drum in the drum over a certain area A. It is known to assign centripetal pumps to both fluid outlets.

A known three-phase separator is illustrated in FIG. 3. If a centripetal pump is assigned to one or both of the two fluid discharges or outlets from the drum and the additional outlet is constructed in a nozzle-type manner, a delta LP area is formed, within which the centripetal pump permits a displacement of the separation zone in the drum by throttling. See, for example, International Patent Document WO 86/01436. Here the area of displaceability of the separation zone is still relatively small, and it is also not easily possible to displace the separation zone in the area sufficiently rapidly. The displacement also does not always lead to stable process conditions because the variation of the throttling of the centripetal pump outlets will influence several parameters of the process simultaneously.

Concerning the state of the art, U.S. Pat. No. 4,417,885 A, Japanese Patent Document JP 03 13 54 58 A, and German Patent Documents DE 1 140 144 and DE 23 22 491 A1 are noted. U.S. Pat. No. 4,417,885 A shows a fluid seal on a centripetal-pump-type outlet of a separator. International Patent Documents WO 2006/096113 and WO 92/07658 also suggest the feeding of pressure in the inlet area of a centrifuge.

Another three-phase separator is known from German Patent Document DE 10 2005 021 331.6. This document suggests a separator having a separator drum, which has an inlet tube for a product to be processed, at least two fluid outlets for a lighter phase and a heavier phase, solid material discharge openings, preferably in the area of its largest inner circumference, a separation pan assembly arranged in the separator drum and an adjustable throttling device outside the drum. The adjustable throttling device has a ring plate or orifice plate and is designed for displacing the fluid radius, to which the heavy phase extends in the drum, by changing the outflow cross-section for the heavy fluid phase by throttling. This construction was found to be successful, but a further constructive simplification is desirable.

The present disclosure relates to a further development of a separator of the above-mentioned type such that, in a constructively simple manner, it is possible to displace the separation zone within the drum over a sufficiently large radial area during the operation. In such a case, a good adjustability of the location of the separation zone is possible.

The present disclosure relates to a separator that includes a separator drum having a conical interior and rotatably mounted at an axial end about a vertical axis of rotation. A rotating spindle located at either a lower or upper end of the separator drum and is configured to drive the separator drum. The rotating spindle is disposed in an oscillating manner about a hinge point. Further included is a supply tube for a product to be processed and at least two fluid outlets. One fluid outlet is for a light phase and one fluid outlet for a heavy phase. A solid material discharge opening is located in an area of the separator drum's largest inner circumference. Also included is a separation pan assembly and a pressure chamber configured to be acted upon by a fluid to change a location of a separation zone between the light phase and the heavy phase.

In accordance with the present disclosure, a very good controllability of the process is obtained and, in the process, a very good automatic controllability of the location of the separation zone, also called E-line. At the same time, the constructive setup is relatively simple.

In accordance with the present disclosure, it is possible to compensate for changes of product quantities, for example, phase relationship, as well as changes of the product quality, for example, the density, and nevertheless keep the separating or E-line almost constant.

It is known that, in the case of a centrifugally acting separator, the pressure may decrease in the center, whereby pressures P1 and P2 are lowered. As a function of the fluid properties, the pressures P1 and P2, as well as the process temperature, the one or both fluid phase(s) may start to evaporate or boil. This may prevent a good separation because gas bubbles or foam may form in the fluid.

In some cases, such as some petroleum crude oils, carbon dioxide may also evolve, which may result in an increase of the pH value in the crude oil and may lead to the formation of calcium naphthenates and other compounds. This may have a very disadvantageous effect on the process stability in the drum.

In addition, the steam pressure of the two fluids may differ, which, because of the difference of the chamber pressures P1 and P2, may result in a displacement of the E-line.

Maintaining pressure on the fluid phases, which is higher than the steam pressure of the corresponding fluids, may avoid these disadvantageous effects and may also be utilized for controlling. For example, automatically controlling the location of the E-line by varying the differential pressure between P1 and P2. The present disclosure also relates to a process in which, by a separator according to the present disclosure, the work takes place according to a step that includes maintaining a pressure on the fluid phases which is higher than the steam pressure of the corresponding fluids.

The separator, according to the present disclosure, is extremely suitable for the most varied three-phase separating tasks. For example, it is suitable for processing crude oil, in which the crude oil is cleansed from solid material and water and is separated from the crude oil. It is also suitable for the treatment of diluted soluble oil, by which water is separated from oil and cleansed from solid material.

On the one hand, it is within the scope of the present disclosure that the fluid outlet for the lighter phase (LP) is provided with a centripetal pump. As an alternative or in addition, the fluid outlet for the heavier phase (HP) may also be provided with a centripetal pump but a centripetal pump is not provided in the embodiment as depicted in FIG. 1.

In accordance with the present disclosure, there are various options for the arrangement of the pressure chamber. Thus, the pressure chamber may be arranged in front of one of the fluid outlets or both fluid outlets. One of the pressure chambers or the one pressure chamber may, however also be constructed in the area of an inlet chamber.

There are other features of the present disclosure disclosed herein.

Other aspects of the present disclosure will become apparent from the following descriptions when considered in conjunction with the accompanying drawings.

DETAILED DESCRIPTION

Figure 1:
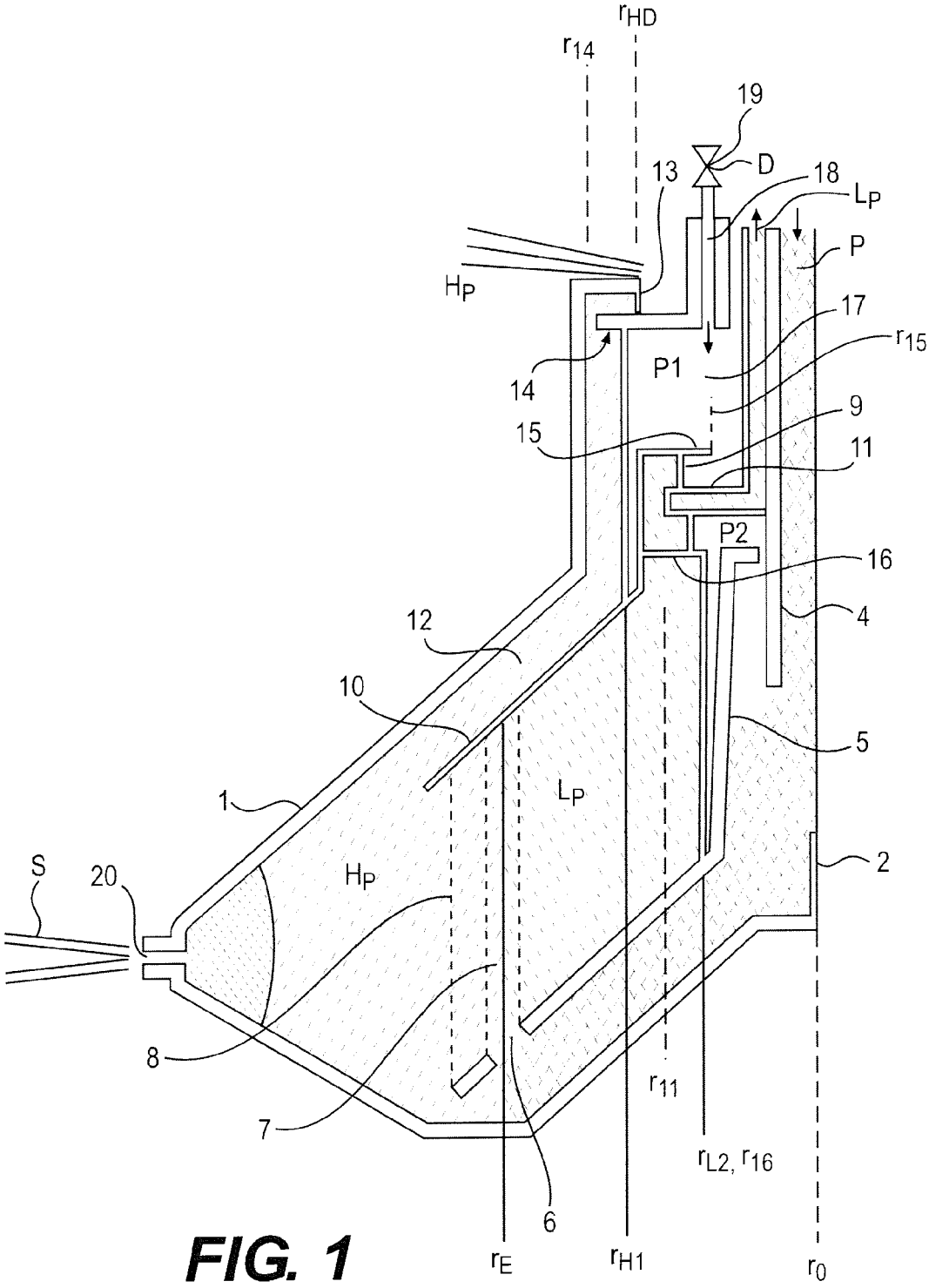
FIG. 1 is a sectional view of one half of a separator drum, according to the present disclosure.
Figure 3:
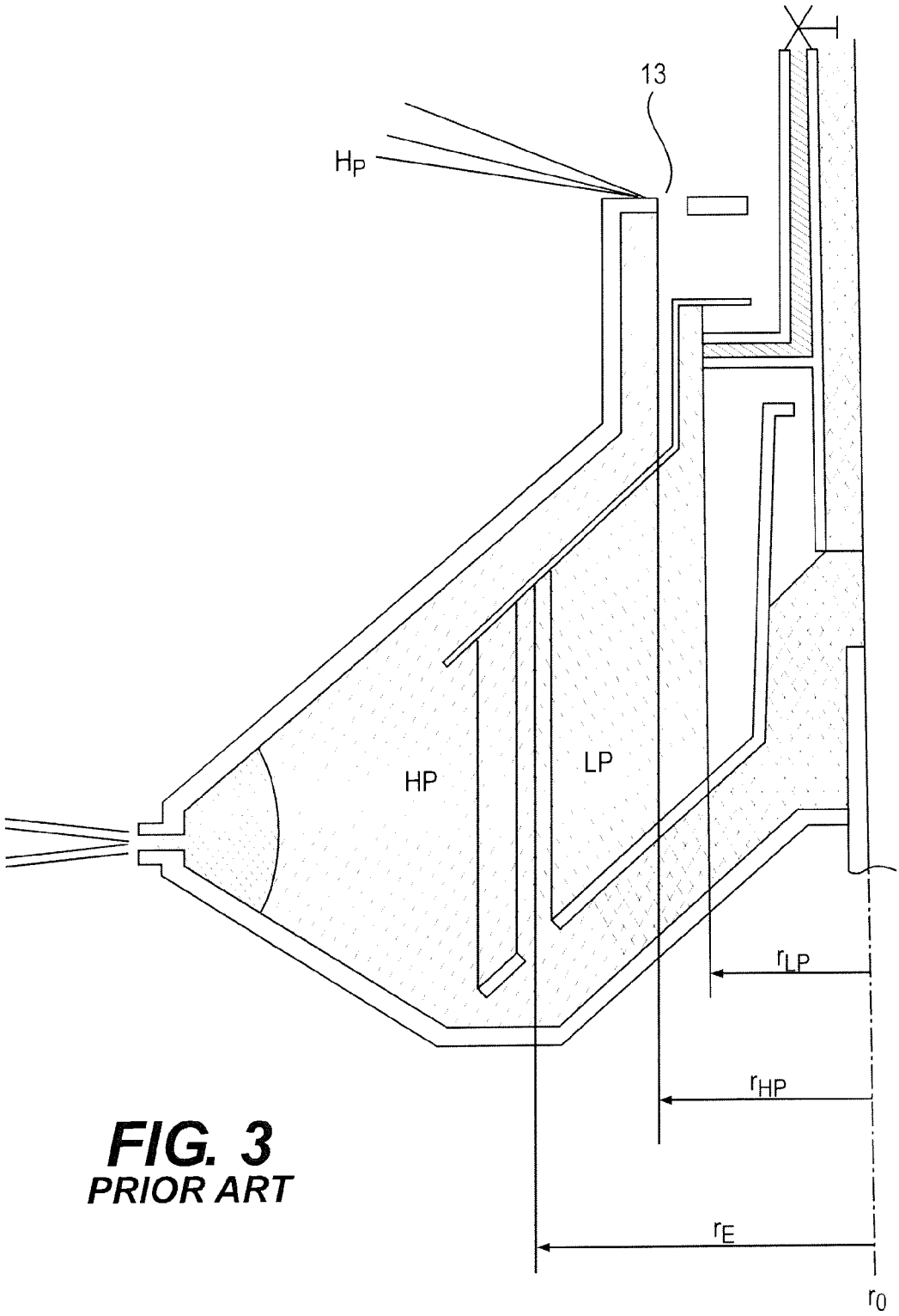
FIG. 3 PRIOR ART
FIG. 3 is a sectional view of one half of a separator drum, according to the state of the art.

FIGS. 1 and 3 each illustrate a separator drum 1 having a vertically oriented axis of rotation at the radius $r_0$.

Figure 2:
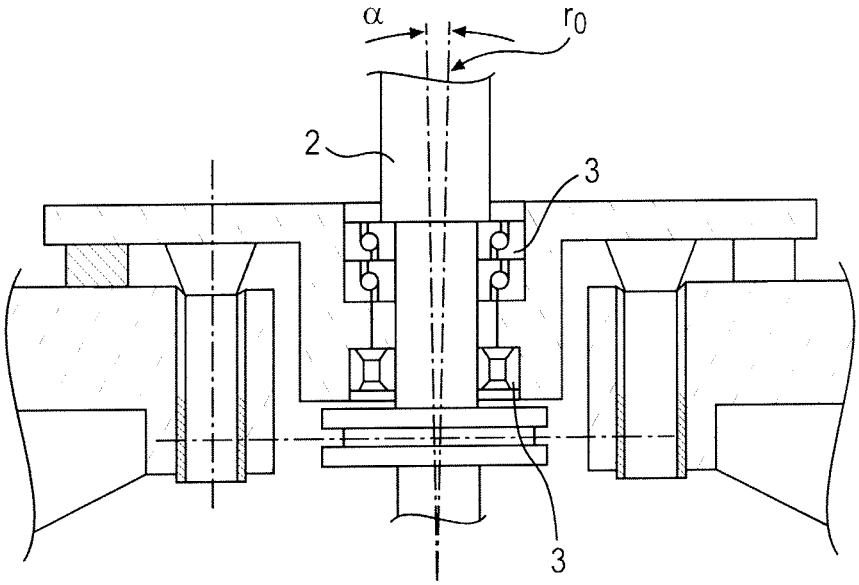
FIG. 2 is a sectional view of an embodiment showing a drive area for the separator drum FIG. 1.

The separator drums 1 are each placed on a rotating spindle 2 which is driven, for example, as illustrated in FIG. 2, directly or by way of a belt (not shown) or in a different manner, for example, by way of a gearing. In its upper circumferential area, the rotating spindle 2 may have a conical development.

By at least one or more roller bearings 3, the rotating spindle 2 is disposed on one side of the drum 1 for example, below the drum, in an oscillating manner. The oscillating operation, therefore, describes or sets a new axis, differently than in the case of a decanter, as a result of residual unbalances which describe a type of precession movement about the vertical line $r_0$, as shown, for example, in FIG. 2, in which the angle of inclination $\alpha$ is illustrated.

In addition to this type of construction, constructions are also known in which a lower drum is quasi "suspended" at the upper rotating spindle 2. However, the drum 1 is rotatably disposed in an oscillating manner only at one of its ends or connected to one of its axial ends.

The separator drum 1 has a supply tube 4 for a product P to be centrifuged, a distributor 5 adjoining this supply tube 4 and being provided with at least one or more outlet openings 6 through which inflowing centrifugal product, shown as cross-hatching, can be guided into the interior of the separator drum 1 and the rising duct 7 of the separation pan assembly 8. A feeding through the spindle 2, for example, from below, is also within the scope of the present disclosure.

In accordance with the present disclosure, the construction of the separator drum 1 is selected such that the outlet openings 6 are situated below the rising duct 7 in the separation pan assembly 8 including conically shaped separation pans. In the upward direction, the separation pan assembly 8 is closed off by a separation pan 10 having a larger diameter than the separation pan assembly 8.

A separation zone between a light or lighter fluid phase LP and a heavy or heavier fluid phase HP is foamed within the separation pan assembly 8. This occurs within the rising duct 7 during an operation in the case of a corresponding rotation of the drum 1 at a certain radius $r_E$ or the emulsion line or separation zone or separating line, which is also called E-line.

The lighter fluid phase LP is guided out of the drum 1 at an inside radius $r_{LP}$ by a centripetal pump 11, which may also be called a gripper. With the aid of the back pressure created by the rotational energy of the fluid, the centripetal pump 11 operates like a pump. A valve for throttling is connected behind the centripetal pump 11, for example, outside the separator drum 1, in a discharge connected on an output side.

In contrast, the heavy fluid phase HP flows around the outer circumference of the separation pan 10 through a discharge duct 12 to a fluid outlet at the upper axial end of the drum 1 at, for example, $r_{HP}$, which is further developed as overflow outlet 13 at the radius $r_{HP}$, as shown in FIG. 3.

As shown in FIGS. 1 and 3, the heavy phase HP flows out of the drum at the overflow outlet 13.

The constructions of FIGS. 1 and 3 correspond to one another to this extent. They can also be provided with the same driving devices.

However, the constructions according to the present disclosure at, for example, that of FIG. 1, in contrast, to that of FIG. 3, is provided with a device, which during the operation, permits a reacting to changing properties of the product to be processed.

The overflow outlet 13 for the heavy phase HP is situated on the radius $r_{HD}$ at the upper axial end of the separator drum 1.

A baffle plate 14 is arranged toward the drum interior axially in front of the overflow 13, which baffle plate 14 extends from the interior toward the outside and its largest radius $r_{14}$ is larger than the radius $r_{HD}$, so that the heavy phase HP has to flow on the outside around the baffle plate 14 before exiting out of the overflow outlet 13.

The centripetal chamber 9 around the centripetal pump 11 is, in addition, bounded axially upward and downward by two blocking disks 15, 16, respectively, which extend radially from the outside toward the inside to the radii $r_{15}$ and $r_{16}$, which are smaller than the outer radius r11 of the centripetal pump 11 as measured axially from the inside to outside. Correspondingly, the centripetal pump 11 projects, by its centripetal pump section with its inlet openings, to a radius r11 which is larger than the inner radius of the blocking disks 15, 16.

Between the baffle plate 14 and the blocking disk 15 bounding the centripetal chamber 9 in the upward direction, a pressure chamber 17 is constructed, and a feeding pipe 18 leads into the pressure chamber 17. The pressure chamber 17 can be acted upon by a fluid, particularly a gas, through the feeding pipe 18 having a valve 19 connected on the input side. A variation of the fluid pressure in the pressure chamber 17 results in a displacing of the fluid level at $R_{H1}$ of the heavy phase HP in the pressure chamber 17 between the inner radius $r_{15}$ and the outer radius $r_{14}$ and in a displacing of the fluid levels of the light phase LP above and below the centripetal pump 11 in the centripetal chamber 9. The displacing of the fluid level takes place because otherwise a flooding of the pressure chamber 17 would occur. The displacing of the fluid level needs to be at no less than radius $r_{L2}$ because that would displace the E-line or $r_E$ into the center of the drum 1 so that no more space would remain for the light phase LP.

Although the outlet radii for the light phase LP and the heavy phase HP are not changed, a variation of the pressure in the pressure chamber 17 leads to an advantageous change of fluid radii in the drum 1 and thus to an influencing of the radius $r_E$ on which the separation zone is situated.

In addition, for example, the double-cone drum 1 has a solid material discharge nozzle 20 in the area of its largest diameter, which nozzle 20 is used for the continuous discharge of solid particles S from the drum 1. However, embodiments with and without additional solid material discharges or with a discontinuous discharge, for example, by a piston slide valve, are also within the scope of the present disclosure.

In a constructively simple manner, the pressure chamber 17 offers a possibility for adjusting and controlling the location of the emulsion line, or E-line, and leads to a better mastering and controlling of the process. This also results in an enlarged adjusting range of the separation zone $r_E$.

Although the present disclosure has been described and illustrated in detail, it is to be clearly understood that this is done by way of illustration and example only and is not to be taken by way of limitation. The scope of the present disclosure is to be limited only by the terms of the appended claims.

I claim:

1. A separator comprising:

a separator drum having a conical interior and rotatably mounted at an axial end about a vertical axis of rotation;

a rotating spindle located at one of a lower and upper end of the separator drum and configured to drive the separator drum, the rotating spindle being disposed in an oscillating manner about a hinge point;

a supply tube for a product to be processed;

a separation pan assembly located in a separation zone of the separator drum;

two fluid outlets, one fluid outlet for a light phase and one fluid outlet for a heavy phase, the fluid outlet for the light phase including a centripetal pump and the fluid outlet for the heavy phase is an overflow outlet which does not include a centripetal pump, and the separation zone is open to the environment via the overflow outlet, a solid material discharge opening located in an area of the separator drum's largest inner circumference;

a pressure chamber configured to be acted upon by a fluid to change a location of a separation zone between the light phase and the heavy phase;

wherein a centripetal chamber around the centripetal pump is bounded in an axially downward and in an axially upward direction by first and second blocking disks, which blocking disks extend radially from an outside circumference of the drum toward an inside circumference of the drum, and which blocking disks have radii extending from the axis of rotation, which radii are smaller than an outer radius of the centripetal pump; and wherein the pressure chamber is constructed between a baffle plate arranged axially in front of the overflow outlet for the heavy phase and one of the blocking disks bounding the centripetal chamber in the axially upward direction.

2. The separator claim 1, wherein the pressure chamber is connected in front of one or both of the fluid outlets.

3. The separator according to claim 1, wherein the pressure chamber is constructed in an area of an inlet chamber.

4. The separator according to claim 1, wherein a radius of the baffle plate being larger than a radius of the overflow outlet for the heavy phase, so that, before exiting from the overflow outlet for the heavy phase, the heavy phase flows around the baffle plate.

5. The separator according to claim 1, wherein a feeding pipe for a fluid leads into the pressure chamber.

6. The separator according to claim 1, wherein the solid material discharge opening is constructed as a nozzle which is designed for a continuous discharge of solid material particles from the drum.

* * * * *